United States Patent [19]

Bristow

[11] Patent Number: 4,673,341

[45] Date of Patent: Jun. 16, 1987

[54] VARIABLE CAPACITY ROLLER- AND VANE-TYPE PUMPS WITH NON-CIRCULAR CAM PROFILE

[75] Inventor: Ian T. Bristow, Higham, England

[73] Assignee: Hobourn-Eaton Limited, Kent, England

[21] Appl. No.: 751,975

[22] Filed: Jul. 5, 1985

[30] Foreign Application Priority Data

Jul. 5, 1984 [GB] United Kingdom ..... 8417146

[51] Int. Cl.[4] ..... F04C 2/344; F04C 15/04

[52] U.S. Cl. ..... 418/26; 418/27; 418/150; 418/225; 418/30

[58] Field of Search ..... 418/24–27, 418/30, 31, 150, 225; 417/220

[56] References Cited

U.S. PATENT DOCUMENTS 2,225,803 12/1940 Smith ..... 418/31

3,711,227 1/1973 Schmitz ..... 418/31

FOREIGN PATENT DOCUMENTS 72830 3/1944 Czechoslovakia ..... 418/31

*Primary Examiner*—John J. Vrablik

*Attorney, Agent, or Firm*—Wenderoth, Lind & Ponack

[57] ABSTRACT

A roller or vane type pump is described of the kind in which the cam ring is pivotally mounted within an external casing to vary the throw of the cam ring and hence the pump delivery means is provided whereby a constant flow is obtained regardless of the pump speed. The cam surface of the cam ring is not wholly circular. The two portions of the cam surface extending between the inlet and outlet ports of the pump at opposite sides respectively of the pump axis have curvatures such that the instantaneous distance $R_2$ of the point of contact of one of the sealing rollers or vanes with the cam surface from the axis of rotation of the rotor is given by $R_2=\sqrt{R_1^2+k}$ where k is a constant and $R_1$ is a corresponding instantaneous distance of the point of contact of the other sealing roller or vane with the cam surface from said axis.

3 Claims, 4 Drawing Figures

VARIABLE CAPACITY ROLLER- AND VANE-TYPE PUMPS WITH NON-CIRCULAR CAM PROFILE

BACKGROUND OF THE INVENTION

This invention relates to roller- and vane-type pumps of the kind comprising a carrier mounted in a casing for rotation about a fixed axis, a cam ring mounted in the casing and extending about the carrier, the carrier having radially extending slots evenly spaced about its periphery in which rollers or vanes are disposed for radial movement in sealing engagement with the radially-inner cylindrical (cam) surface of the cam ring whereby chambers are formed between adjacent elements which increase and decrease in volume, as the carrier rotates about said axis, to pump fluid from the inlet port to the outlet port of the pump, the cam ring being mounted for guided movement in a direction substantially radially of the carrier thereby to vary the change in volume of the chambers in their pumping cycle and hence the delivery of the pump. At any instant at generally opposite diametral sides of the carrier two of the rollers or vanes form seals between respective adjacent circumferential ends of the inlet and outlet ports; when the number of rollers or vanes is even these two sealing rollers are diametrically opposite each other, but when the number is odd one of the sealing rollers is circumferentially displaced from the diametrically opposite position by half the angular pitch of the rollers.

The common practice in forming the cam rings of such pumps is to make the cam profile fully circular, which is the ideal profile only when the cam ring and carrier are concentric, i.e. when the pump is doing no useful work. Whenever the pump is doing useful work the two rollers or vanes which are instantaneously forming the seals between the inlet and outlet ports are moving along surfaces which are not concentric with the carrier and the two sealing rollers or vanes are therefore moving radially but to different extents and this leads to noisy operation which can be objectionable.

BRIEF SUMMARY OF THE INVENTION

According to this invention there is provided a pump of the kind referred to wherein the said cam surface is arcuate but non-circular in profile, the cam profile in the two angular extents thereof between the circumferential ends of the inlet and exhaust ports being such that when the cam ring is in a predetermined position of adjustment relative to the carrier, then considering the two sealing elements, as each moves through the angular distance between the circumferential ends of the inlet and outlet ports the instantaneous distance $R_2$ of the point of contact of one of said sealing elements with the cam profile from the axis of rotation of the carrier is given by $R_2=\sqrt{R_1^2+k}$ where k is a constant which may be positive or negative but which is not zero, and $R_1$ is the instantaneous distance of the point of contact of the other of said sealing elements with the cam profile from the axis of rotation of the carrier.

In one preferred form of pump according to the invention $R_1$ and $R_2$ are constant so that the cam profile over each of the two angular portions thereof between the ends of the inlet and outlet ports is an arc of a circle centred on the axis of rotation of the carrier, the two arcs being of different radii.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS

Figure 2:
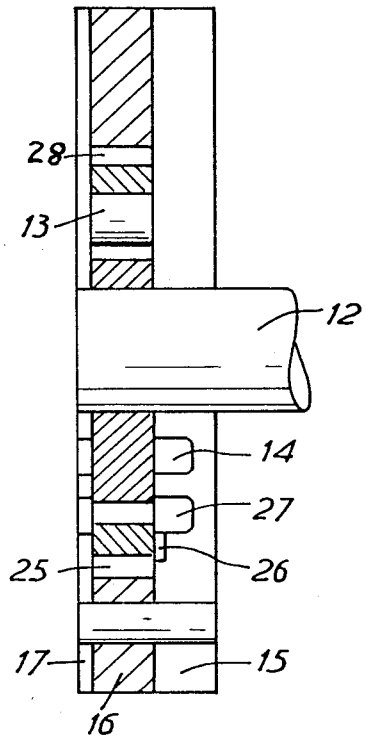
FIG. 2 is a partial sectional elevation on the line 2—2 of FIG. 1.

Referring to the drawings, a pump is shown which operates to maintain a constant-pressure output by control of the position or throw of a cam ring 10 encircling a carrier 11 which is mounted on a shaft 12 rotating about a fixed axis. The carrier has peripheral slots in which rollers 13 are slidably mounted. The rollers 13 are urged outward by centrifugal force into rolling contact with the internal surface of the cam ring and, in the illustrated construction, by pressure fluid derived from the pump output and supplied to the inner ends of the slots from galleries 14 in an end plate 15 of an external casing comprising an annular member 16 flanked by end plates 15, 17. Arcuate inlet and outlet ports 24, 27 are formed in the end plate 15. The cam ring 10 pivots about a roller 18 which is engaged in part-cylindrical recesses in the casing and in the cam ring. A roller 19 is disposed between a part-cylindrical internal surface 20 of the casing and a part-cylindrical external surface 21 of the cam ring, these surfaces being centred on the axis of the pivot roller 18 so that roller 19 forms a seal between the two parts of the space between the cam ring and the casing and serves also to hold the cam ring in engagement with the pivot roller. A spring 23 seated against a tangentially facing internal surface 22 of the casing acts against a radially-outwardly extending lug 10a on the cam ring and urges the cam ring into a position of maximum throw relative to the carrier.

The pivot roller 18 and roller 19 may conveniently be identical to the rollers 13 on the carrier and have their axial ends similarly in sealing abutment with the two end plates 15, 17 of the pump casing. Rollers 18 and 19 both also form seals between the cam ring and the casing so as to form two sealed chambers 25, 28. Chamber 28 is permanently vented by being in communication with the inlet duct of the pump. Chamber 25 communicates with the delivery passage 27 of the pump through an orifice 26. The delivery pressure of the pump thus acts against the force of spring 23 and tends to reduce the throw of the cam ring and hence the quantity and pressure of the fluid in the delivery passage of the pump. The arrangement thus acts to maintain a constant delivery pressure regardless of the pump speed.

The ends of rollers 18 and 19 may if desired be engaged in recesses in the end plates 15 and 17.

The torque acting on the cam ring 10 due to the fluid pressure in the chambers varies in dependence upon the instantaneous positions of the rollers 13. The variations in the torque tend to cause oscillation of the cam ring which, in the illustrated construction, is damped by limiting the dimensions of the orifice 26 through which fluid flows into and out of the chamber 25. In order to allow the cam ring to move rapidly when either the speed changes or the output pressure changes, the damping effect should be low. At low pump speeds the throw of the cam ring will generally have a high value but the frequency of the oscillating torque is low and the damping effect is required to be high, so that the effective area of the orifice 26 is required to be low. At high pump speeds, the frequency of the oscillating torque is high and the throw of the cam ring will have a low value and the damping effect is required to be low so that to obtain the same damping effect the effective area of the orifice 26 is increased. In the construction illustrated in FIGS. 1-4, the effect is achieved by having the orifice 26 in the form of a slot in the end plate of the pump which slot tapers in width in the radially outward direction. Thus, as the eccentricity increases, the effective area of communication between the delivery passage 27 and the chamber 25 decreases as the cam ring blanks off an increasing proportion of the area of the slot, providing the required increasing damping effect and vice versa. The shape of the orifice can be designed to produce the required damping characteristic.

The arrangement is equally suitable where vanes are employed in place of rollers 13.

By varying the damping effect in this manner, the maximum response time of the cam movement to counteract variations of external pressure or change in the pump speed can be minimised.

The friction force of the rollers or vanes on the cam ring depends upon the number of rollers or vanes and, therefore, the fewer used, the more efficient the pump. However, the fewer the number of rollers or vanes, the greater the fluctuation of the instantaneous torque on the cam ring. The variable damping enables fewer rollers or vanes to be used for the same response time of the system.

In alternative arrangements, chamber 25 is in unrestricted communication with the outlet duct of the pump and the variable damping is achieved by employing a restriction in the communication between the inlet duct and chamber 28 similar to the port 26, the effective area of which is determined by the position of the cam ring.

Other forms of variable damping device can be employed to act on the movement of the cam ring.

The instantaneous output flow from the pump is dependent upon the instantaneous difference in the square of the radii at the points of sealing. With a cam profile which is truly circular there is a continuous variation in the difference between these two sealing radii causing variation in the output flow, which causes noise except when there is no output, i.e. when the centre of the cam profile coincides with the axis of rotation of the carrier.

Figure 3:
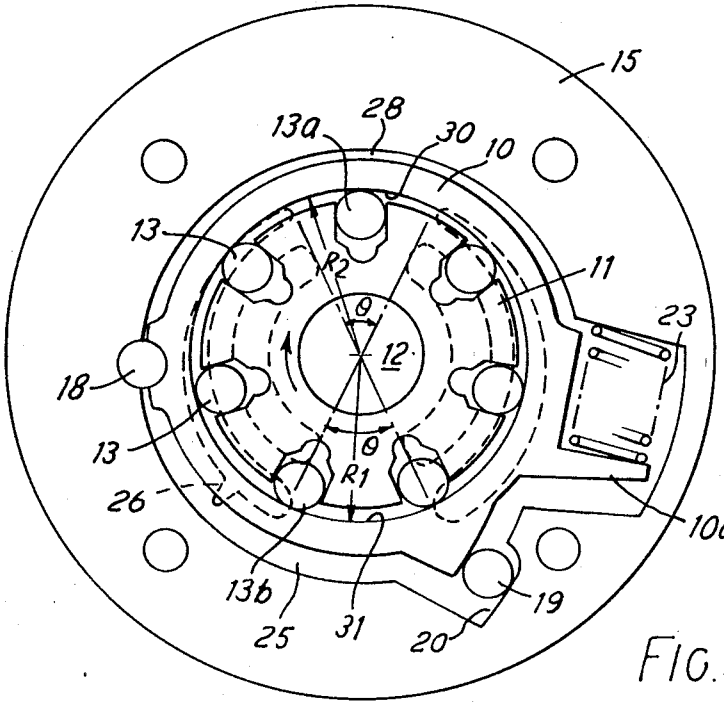

In applying the present invention, a position of the cam ring relative to the carrier is selected which will cause the pump to deliver the maximum (FIG. 1) or a predetermined proportion (FIG. 3) of the maximum delivery pressure of the pump, ie. at a constant rate of flow, at which delivery it is desired that the pump should operate quietly. As is illustrated in FIG. 3, the predetermined proportion (less than all) of the maximum delivery is provided when the cam ring is intermediate its extreme positions. In this predetermined position of the carrier, the two sealing rollers are to move along respective arcs on the cam profile, which arcs are designed to produce the required quiet operation.

The delivery flow of the pump (which is to be maintained constant) at each instant is proportional to $\sqrt{R_1^2-R_2^2}\times L$ where $R_1$ and $R_2$ are respectively the instantaneous distances of the two sealing rollers from the axis of rotation of the carrier and L is the axial length of the carrier and rollers.

i.e.

$$\text{Flow}=a\sqrt{R_1^2-R_2^2}\times L$$

where a is a constant or $$\sqrt{R_1^2-R_2^2}=\text{constant since the flow (by definition), the flow, L and a are all constant}$$

$$\therefore R_1^2-R_2^2=\text{constant}$$

$$\therefore R_1=\sqrt{R_2^2+k} \qquad (1)$$

when k is a constant which may be positive or negative but not zero, since if k is zero there is no delivery by the pump.

By means of this formula, when either $R_1$ or $R_2$ has been set, the other can be calculated.

Figure 1:
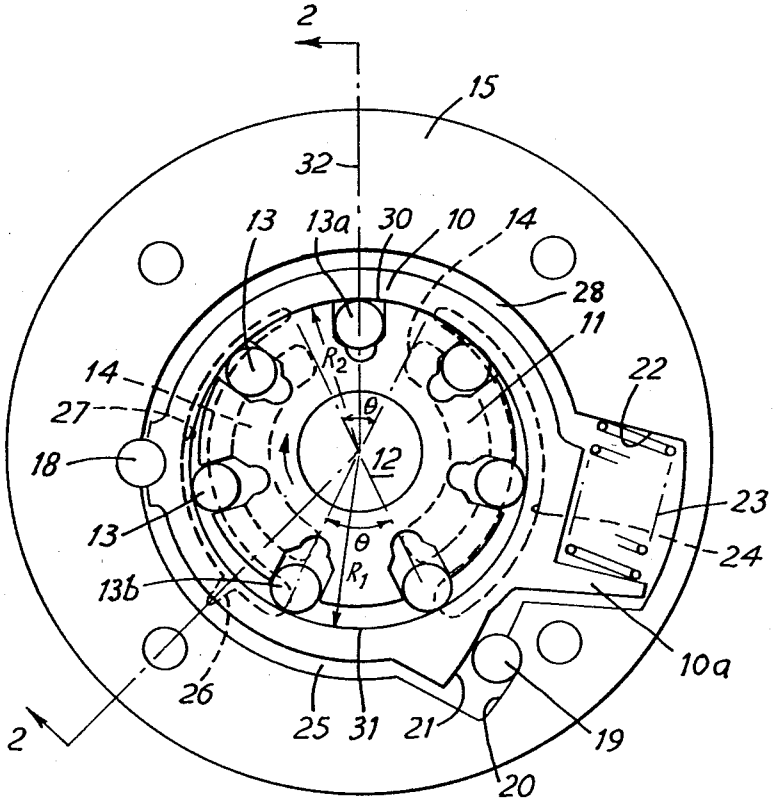
FIGS. 1, 3 and 4 are end views of a pump according to respective first, second and third embodiments of the invention with one of the end plates removed.

In the embodiment of the invention, shown in FIGS. 1 and 2, the inlet and outlet ports are indicated at 24 and 27, and the two sealing rollers are shown at **13*a* and 13*b* respectively, the direction of rotation of the carrier being clockwise as indicated. In this instance the pump is required to operate quietly when the pump delivery is a maximum i.e. when the throw of the cam ring is a maximum. If the instantaneous distance of roller 13*b* from the axis of rotation the carrier is $R_1$, then the distance $R_2$ of the roller 13*a* is determined from the formula (1) above, the constant k being determined partly from output flow required and the length of the pump. In the illustrated construction $R_1$ and $R_2$ are constant over the respective arcs 31, 30 extending between the adjacent circumferential ends of the inlet and outlet ports 24, 27, these arcs each having an angular extent 0** equal to the angular pitch of the rollers.

It will be noted that since the pump shown has an odd number of rollers, one of the sealing rollers is offset from a position diametrically opposite the other by half the angular pitch of the rollers. In a pump having an even number of rollers the sealing rollers will be diametrically opposite each other.

The ends of the circular arcs 31, 30 of the cam profile are interconnected by arcs which are designed to impart smooth radial acceleration and deceleration to the rollers and, if desired, to provide a precompression arc in the known manner.

FIG. 3 is a view of a pump similar to that of FIG. 1 but with a cam profile designed so that the pump delivers a predetermined proportion of the maximum delivery of the pump, at which delivery it is desired that the pump should operate quietly. The carrier 16 is shown in its predetermined position of quiet delivery, and in this position the two sealing rollers move along respective arcs of radii $R_1$ and $R_2$ respectively which are centered on the axis of rotation of the carrier and the values of which are interrelated by formula (1) above.

It will however be understood that the formula expresses the relationship of the radii at the instantaneous corresponding points of contact of the two sealing rollers with cam profile and it is not essential for $R_1$ and $R_2$ to be constant over the respective arcs. It may be desirable in some circumstances for $R_1$ and $R_2$ to decrease over the circumferential length of the arcs in the direction of rotation of the carrier so that the cam profile causes the sealing rollers to be moved inward in their respective pockets in the carrier, for example, to increase the sealing pressure exerted between the sealing rollers and the cam profile.

Figure 4:
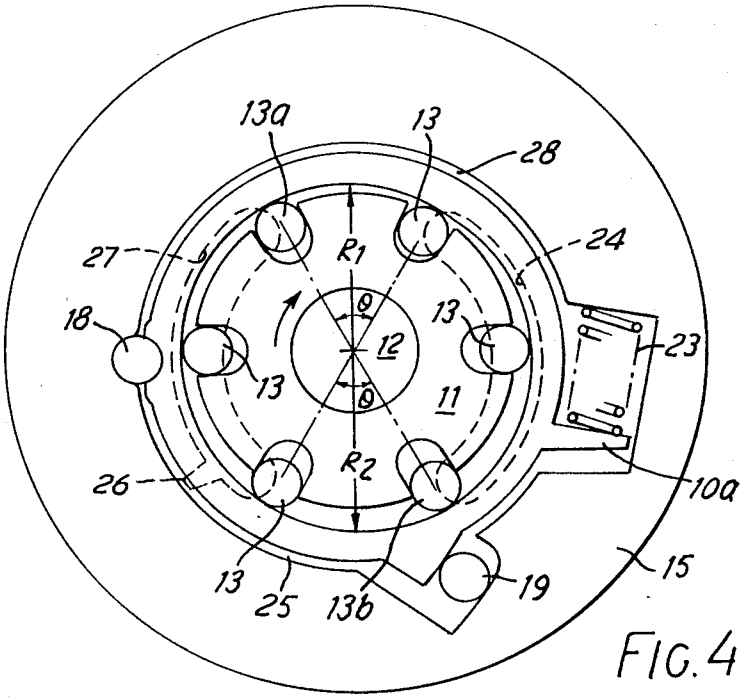

FIG. 4 incorporates reference numerals corresponding to those in FIG. 1 and shows a pump having an even number of rollers so that the sealing rollers 13*a* and 13*b* just coming into operation are diametrically opposite each other and respectively engage sealing arcs of radii $R_1$ and $R_2$ both of which decrease over the circumferential length of the arcs. At each instant, the radii $R_1$ and $R_2$ of the sealing arcs at the respective points of contact of the two sealing rollers therewith are interrelated by the formula (1) above. Thus, the value of $R_1$ at each instant can be set, and the corresponding value of $R_2$ calculated from the formula.

I claim:

1. A pump comprising a casing having an inlet port and an outlet port; a carrier mounted in the casing for rotation about a fixed axis; a cam ring mounted in the casing and extending about the carrier, the carrier having radially extending slots evenly spaced along its periphery; and piston elements disposed in the slots for radial movement in sealing engagement with a radially inner cylindrical cam surface of the cam ring whereby chambers are formed between adjacent ones of the piston elements which increase and decrease in volume as the carrier rotates about said axis, to pump fluid from the inlet port to the outlet port of the pump, two of the piston elements at any instant constituting sealing elements between adjacent ends of the the inlet and outlet ports; the cam ring being mounted for guided movement in a direction substantially radially of the carrier between first and second predetermined positions thereby to vary the change in volume of the chambers in their pumping cycle and hence the delivery of the pump, between a predetermined maximum and a predetermined minimum change, respectfully; said cam surface being arcuate but not completely circular in profile, the cam profile in two angular extents thereof between the circumferential ends of the inlet and outlet ports being such that when the cam ring is in a predetermined position of adjustment relative to the carrier, which predetermined position is intermediate said first and second positions, then as each of the two piston elements constituting sealing elements moves through the angular distance between the circumferential ends of the inlet and outlet ports, the instantaneous distance $R_2$ of the point of contact of one of said sealing elements with the cam profile from the axis of rotation of the carrier is constant and is given by $R_2=\sqrt{R_1^2+k}$ where k is a constant which may be positive or negative but which is not zero, and $R_1$ is the instantaneous distance of the point of contact of the other of said sealing elements with the cam profile from the axis of rotation of the carrier and is constant.

2. A pump comprising:

a casing having an inlet port and an outlet port;

a carrier mounted in the casing for rotation about a fixed axis;

a cam ring mounted in the casing and extending about the carrier, the carrier having radially-extending slots evenly spaced along its periphery;

and piston elements disposed in the slots for radial movement in sealing engagement with a radially inner cylindrical cam surface of the cam ring whereby chambers are formed between adjacent ones of the piston elements which increase and decrease in volume as the carrier rotates about said axis, to pump fluid from the inlet port to the outlet port of the pump, two of the piston elements at any instant constituting sealing elements between adjacent ends of the inlet and outlet ports;

the cam ring being mounted for guided movement in a direction substantially radially of the carrier thereby to vary the change in volume of the chambers in their pumping cycle and hence the delivery of the pump;

said cam surface being arcuate but not completely circular in profile, the cam profile in the two angular extents thereof between the circumferential ends of the inlet and outlet ports being such that when the cam ring is in a predetermined position of adjustment relative to the carrier, then as each of the two sealing elements constituting piston elements moves through the angular distance between the circumferential ends of the inlet and outlet ports the instantaneous distance $R_2$ of the point of contact of one of said sealing elements with the cam profile from the axis of rotation of the carrier decreases progressively in the direction of rotation of the carrier and is given by $R_2=\sqrt{R_1^2+k}$ is a constant which may be positive or negative but which is not zero, and $R_1$ is the instantaneous distance of the point of contact of the other of said sealing elements with the cam profile from the axis of rotation of the carrier and decreases progressively in the direction of rotation of the carrier.

3. A pump comprising:

a casing having an inlet port and an outlet port;

a carrier mounted in the casing for rotation about a fixed axis;

a cam ring mounted in the casing and extending about the carrier, the carrier having radially extending slots evenly spaced along its periphery;

and piston elements disposed in the slots for radial movement in sealing engagement with a radially inner cylindrical cam surface of the cam ring whereby chambers are formed between adjacent ones of the piston elements which increase and decrease in volume as the carrier rotates about said axis, to pump fluid from the inlet port to the outlet port of the pump, two of the piston elements at any instant constituting sealing elements between adjacent ends of the inlet and outlet ports;

the cam ring being mounted for guided movement in a direction substantially radially of the carrier thereby to vary the change in volume of the chambers in their pumping cycle and hence the delivery of the pump;

said cam surface being arcuate but not completely circular in profile, the cam profile in the two angular extents thereof between the circumferential ends of the inlet and outlet ports being such that when the cam ring is in a predetermined position of adjustment relative to the carrier, then as each of the two piston elements constituting the sealing elements moves through the angular distance between the circumferential ends of the inlet and outlet ports the instantaneous distance $R_2$ of the point of contact of one of said sealing elements with the cam profile from the axis of rotation of the carrier varies in a predetermined manner in the direction of rotation of the carrier and is given by $R_2=\sqrt{R_1^2+k}$ where k is a constant which may be positive or negative but which is not zero, and $R_1$ is the instantaneous distance of the point of contact of the other of said sealing elements with the cam profile from the axis of rotation of the carrier.

* * * * *

UNITED STATES PATENT AND TRADEMARK OFFICE

CERTIFICATE OF CORRECTION

PATENT NO. : 4,673,341

DATED : June 16, 1987

INVENTOR(S) : Ian T. BRISTOW

It is certified that error appears in the above-identified patent and that said Letters Patent is hereby corrected as shown below:

Column 6, line 21: preceding "is" (last occurrence)

insert --where k--.

Signed and Sealed this

Twenty-fourth Day of May, 1988

*Attest:*

DONALD J. QUIGG

*Attesting Officer*

*Commissioner of Patents and Trademarks*